US005357929A

United States Patent [19]

McCandless

[11] Patent Number: 5,357,929

[45] Date of Patent: Oct. 25, 1994

[54] ACTUATION FLUID PUMP FOR A UNIT INJECTOR SYSTEM

[75] Inventor: James C. McCandless, Palatine, Ill.

[73] Assignee: Navistar International Transportation Corp., Chicago, Ill.

[21] Appl. No.: 128,403

[22] Filed: Sep. 29, 1993

[51] Int. Cl.[5] ..... F02M 41/00; F02M 37/04

[52] U.S. Cl. ..... 123/446; 123/510; 123/458

[58] Field of Search ..... 123/510, 514, 446, 456, 123/458

[56] References Cited

U.S. PATENT DOCUMENTS

| | | | |
|---|---|---|---|
| Re. 33,270 | 7/1990 | Beck et al. | 123/458 |
| 4,165,348 | 8/1979 | Nakamura | 123/510 |
| 4,167,169 | 9/1979 | White | 123/458 |
| 4,187,813 | 2/1980 | Stumpp | 123/510 |
| 4,418,671 | 12/1983 | Kelso et al. | 123/458 |
| 4,434,777 | 3/1984 | Straubel | 123/458 |
| 4,440,134 | 4/1984 | Nakao et al. | 123/458 |
| 4,807,583 | 2/1989 | Thornwaite et al. | 123/510 |
| 4,870,940 | 10/1989 | Filippi et al. | 123/514 |
| 5,085,193 | 2/1992 | Morikawa | 123/458 |
| 5,121,730 | 6/1992 | Ausman et al. | 123/467 |
| 5,233,944 | 8/1993 | Mochizuki | 123/510 |
| 5,245,970 | 9/1993 | Iwaszkiewicz et al. | 123/447 |

*Primary Examiner*—E. Rollins Cross
*Assistant Examiner*—Thomas N. Moulis
*Attorney, Agent, or Firm*—Dennis K. Sullivan

[57] ABSTRACT

A diesel engine hydraulically-actuated, electronically-controlled unit injector fuel injection system is provided with a two-stage pump system including two parallel pumps for supplying actuating fluid to the injectors. The first stage pump of this two-stage pump has a capacity which is adequate for most operating modes. The second stage pump is used for starting and for high engine load situations. The second stage pump is controlled by a solenoid bypass valve that switches in the second stage pump when the pressure in the high pressure rails fall below a desired or programmed level. An embodiment of this invention includes a second bypass circuit having a fast-response, solenoid-actuated bypass valve that bypasses all of the flow from both stages between injections and thereby produces a pulsed flow of actuation fluid to produce the required pressure for each engine fuel injection while unloading the pumping system between injections.

21 Claims, 7 Drawing Sheets

ACTUATION FLUID PUMP FOR A UNIT INJECTOR SYSTEM

BACKGROUND OF THE INVENTION

The present invention relates generally to fuel injection systems and, more particularly, to a hydraulically-actuated, electronically-controlled unit injector fuel system, hereinafter referred to as a HEUI fuel injection system, having an improved variable pumping system for the actuating oil to improve the engine fuel consumption compared to current HEUI fuel injection systems.

THE PRIOR ART

HEUI injection rate/pressure characteristics are a function of oil supply (rail) pressure, which is programmable and independent of engine speed and load. As a result, it is possible to provide a diesel engine with an optimum injection characteristic, regardless of operating mode. A current HEUI fuel injection system is disclosed in U.S. Pat. No. 5,121,730 and U.S. Pat. No. 5,245,970, the contents of which patents are incorporated herein by reference. A problem that exist in HEUI fuel injection systems of the type disclosed in these prior art patents is that the actuating fluid pump, which is driven by the engine, must have the capacity to meet the highest pressure requirements which occur when the engine is developing peak torque. At peak torque, an engine is rotating at a relative low speed, for example, about 2,000 revolutions per minute, and, accordingly, drives the actuating fluid pump at a relatively low rate. Thus, an actuating fluid pump must be selected that has the pumping capacity to meet the engine's peak torque pressure requirements while being driven at a relatively low rate. A result of selecting the pump based on the engines peak torque requirements is that, at all other conditions, the pump will be pumping greater oil quantities than the fuel system requires. In the HEUI fuel injection system disclosed in the above-identified prior art patents, a swash plate type actuating fluid pump was selected because of its high volumetric efficiency at low pump speeds. Swash plate type pumps are expensive compared to other types of pump, and will have excess capacity at other than peak torque. This excess capacity is regulated by the use of relief valves. When pump output pressure exceeds desired system pressure, the relief valves open and vent excess flow to drain.

The general problem with the current system is that the supply pump delivery characteristics versus engine speed do not meet the engine requirements. Furthermore, the power requirement necessary to maintain the actuating oil at high pressure between actuation of the injectors is nonproductive and the practice of regulating the pressure in the high pressure rails by relief valves results in high parasitic loses and, in general, an engine having a poorer brake specific fuel consumption (BSFC) than it might otherwise have. At some speed/-load conditions, 90% of the pump drive power is wasted.

Finally, although two-stage gear pumps per se are known, the application thereof to supply actuating fluid for a HUEI fuel system for an engine, is not previously known.

SUMMARY OF THE INVENTION

The present invention is directed to a HEUI fuel injection system in which the pumping system for the actuating oil is variable such that it matches the engine requirements at peak torque conditions and other conditions to thus improve the fuel consumption from that of current HEUI fuel injection systems.

The preferred embodiment of this invention includes a two-stage actuating fluid pump which utilizes two gear-type pumps in parallel. The first stage pump of this two-stage pump has a capacity which is adequate for most operating modes. The second stage pump, is used for starting and for high engine load situations. The second stage pump is controlled by a solenoid bypass valve that switches in the second stage pump when the pressure in the high pressure rails fall below a desired or programmed level. When the pressure in the high pressure rails are at or above the desired or programmed level, the flow from the second stage pump is bypassed to the pump inlet.

In another embodiment, a two-stage gear pump is utilized including a second stage bypass as in the preferred embodiment as well as a fast-response, solenoid-actuated bypass that has the capacity to bypass the high pressure rails between engine fuel injections. In this embodiment, the second stage of the two-stage gear pump contributes to the total flow only when the rail pressure drops below a desired or programmed amount. In addition, the system utilizes a fast-response solenoid valve to bypass the first stage gear pump at a rate to effectively bypass the pumps between injections of fuel into the engine cylinders. In this embodiment, it is important that the size of the actuating fluid pump is minimized to reduce high speed fluid acceleration losses. In an effort to minimize the actuating fluid pump size, for an eight (8) cylinder engine a four (4) cylinder start strategy can be utilized, which reduces the quantity of actuating fluid required in a hot start operation.

In either embodiment, it is presently preferred for manufacturing reasons that both pump stages have the same capacity. However, the relative sizes of the pump stages may be tailored to suit the particular application of the engine on which the HUEI fuel system including the invention is incorporated.

This invention provides an advantage over the prior art by operating at a more efficient rate and producing a significant fuel savings. According to the invention, a fuel injection actuation fluid pump system is connected by a high pressure line to the high pressure rail for supplying actuating fluid to hydraulically-actuated electronically controlled unit injectors, the high pressure rail includes sensing and transmitting means for monitoring the fluid pressure and transmitting signals indicating the pressure, the fluid pump system including a normally-open fast-response solenoid-actuated bypass valve in its bypass circuit that is actuated by signals from said sensing and transmitting means that cause the valve to sequence in response to each fuel injection.

DETAILED DESCRIPTION OF THE PREFERRED EMBODIMENT

Figure 1:
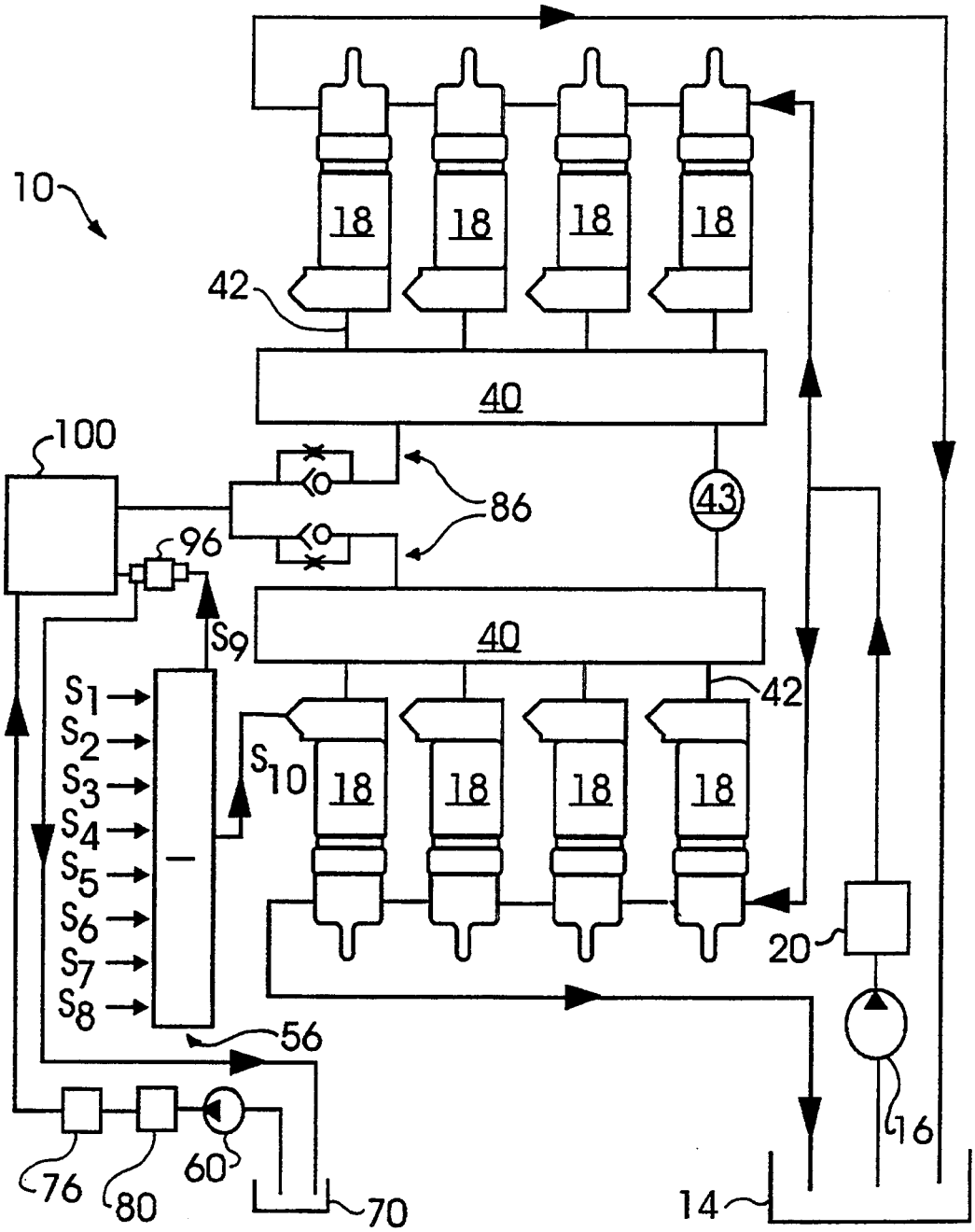
FIG. 1 is a diagrammatic general schematic view of a hydraulically-actuated electronically-controlled unit injector fuel system, for an internal combustion engine having a plurality of unit injectors.

The basic operation of a conventional HEUI fuel injection system will be described with reference to FIGS. 1, 2 and 3. For a more detailed description, reference should be had to U.S. Pat. No. 5,121,730 and U.S. Pat. No. 5,245,970. A HEUI fuel injection system 10 includes a unit injector 18 for each cylinder of the engine 12. The major external components of each unit injector 18 are the solenoid assembly 54, valve body 46, injector body 28 and needle stem 34. The assembled unit injectors 18 are secured, by unit injector clamps 62, in unit injector bores 58 that are formed in the engine cylinder head 22.

Figure 2:
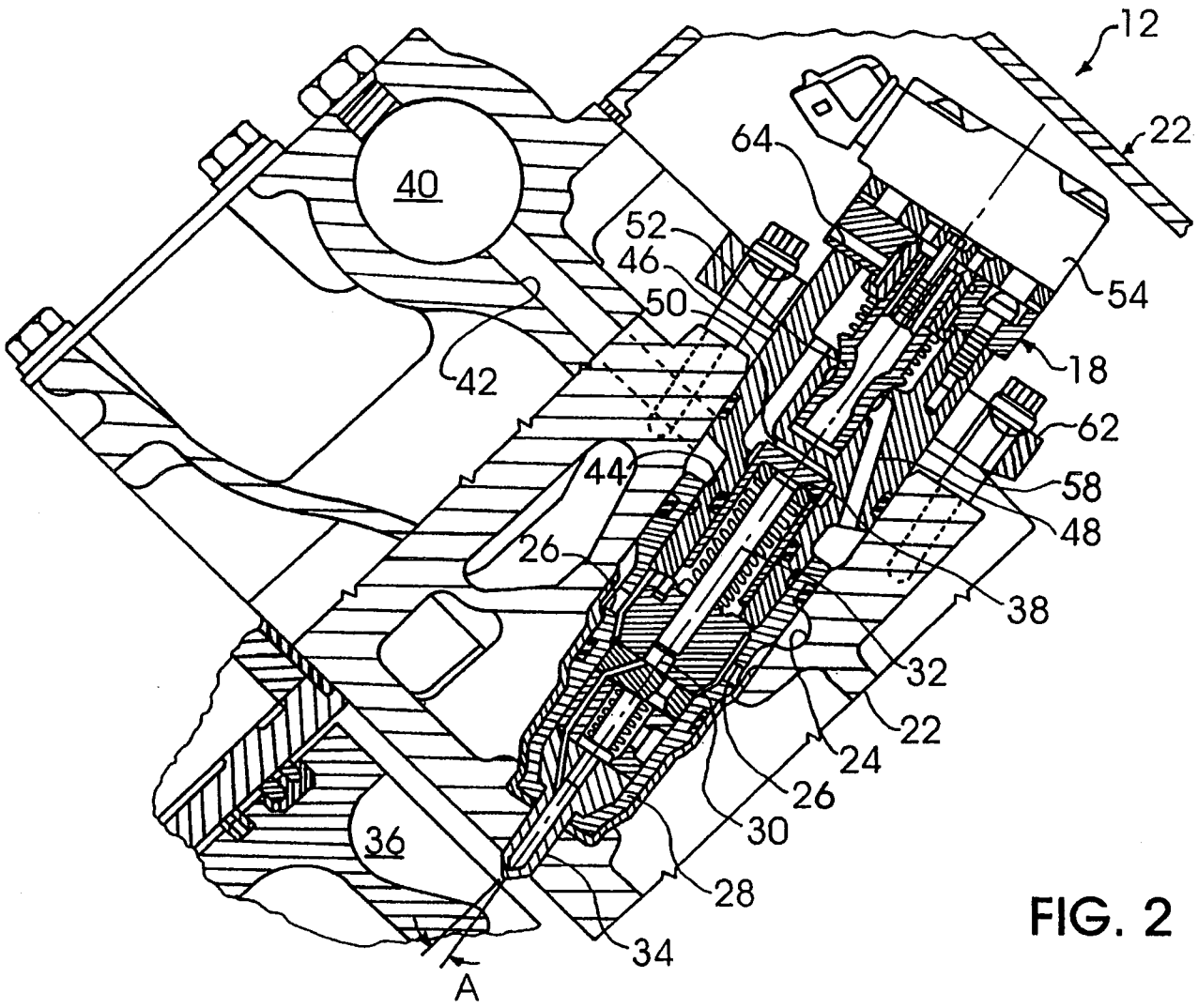
FIG. 2 is a diagrammatic partial cross-sectional view of a unit injector, of the type shown in FIG. 1, installed in an internal combustion engine.

As seen in FIG. 1, fuel is supplied to the unit injectors 18 from a fuel tank 14 through a priming pump 16 and a conditioning unit 20. As seen in FIG. 2, the unit injector bores 58 have fuel manifolds 24 formed therein into which fuel is fed. The fuel in manifolds 24 flows through fuel inlet holes 26, formed in the injector body 28, into the fuel pump chambers 30. When plunger 32 is forced downwardly the fuel is injected through the needle stem 34 into a combustion chamber 36 of the engine 12. The plunger 32 is caused to move downwardly when hydraulic pressure is exerted on the intensifier piston 38.

Actuation oil, which is preferably from the engine lubricating oil, is pumped into high pressure rails 40 that are connected by rail branch passages 42 to an annular fluid inlet passage 44 formed in each piston valve body 46. In FIG. 1, two high pressure rails 40 are shown each of which supply actuating fluid to four unit injectors 18. An actuating fluid inlet passage 48 is formed in each piston valve body 46 through which the pressurized oil communicates with a poppet valve 52. When the poppet valve 52 is opened by solenoid assembly 54 the pressurized oil flows into the piston pump chamber 50. As previously discussed, this pressurized oil causes intensifier piston 38 to move downwardly. As best seen in FIG. 1, the actuation oil is placed under pressure by a high pressure actuation fluid pump 100 of the swash plate type and the solenoid assembly of each injector 18 receives an electronic signal from a programmable microprocessor or electronic control module 56.

The programmable electronic control module 56 receives input data signals including engine speed $S_1$, engine crankshaft position $S_2$, engine coolant temperature $S_3$, engine exhaust back pressure $S_4$, air intake manifold pressure $S_5$, throttle position or desired fuel setting $S_7$, and automatic transmission operating condition $S_8$. A sensing and transmitting means 43 is provided in the high pressure rail or rails 40 that sends a signal $S_6$ back to the programmable electronic control module 56. The electronic control module 56 is programmed with various multidimensional control strategies or logic maps which take into account the input data and then compute a pair of desired or optimal output control signals $S_9$, $S_{10}$. Output control signal $S_9$, is the actuating high pressure rail pressure command signal that is directed to the primary pressure regulator 90. Primary pressure regulator 90 functions to adjust the output pressure of the pump 100 which in turn determines the pressure of the actuating fluid in the high pressure rails 40. Output control signal $S_{10}$ determines the time for starting fuel injection and the quantity of fuel to be injected during each injection phase. Signal $S_{10}$ causes a selected waveform to be directed to the solenoid actuator 54 of each unit injector 18.

Fluid from the pump 100 flows through the Helmholtz valves 86, that function to control the creation of Helmholtz resonance, to the high pressure rails 40. Each Helmholtz valve 86 includes a one-way check valve 94 and a flow restrictor 95.

When starting the engine, actuating oil at a desired or programmed pressure, must be available in each inlet passage 48 such that when the corresponding injector popper valve 52 is actuated by the solenoid assembly 54, actuating oil flows into the piston pump chamber 50. The actuating oil also functions as a damping fluid for the poppet valve 52 and is drained from piston pump chamber 50 through a drain passage 64.

Figure 3:
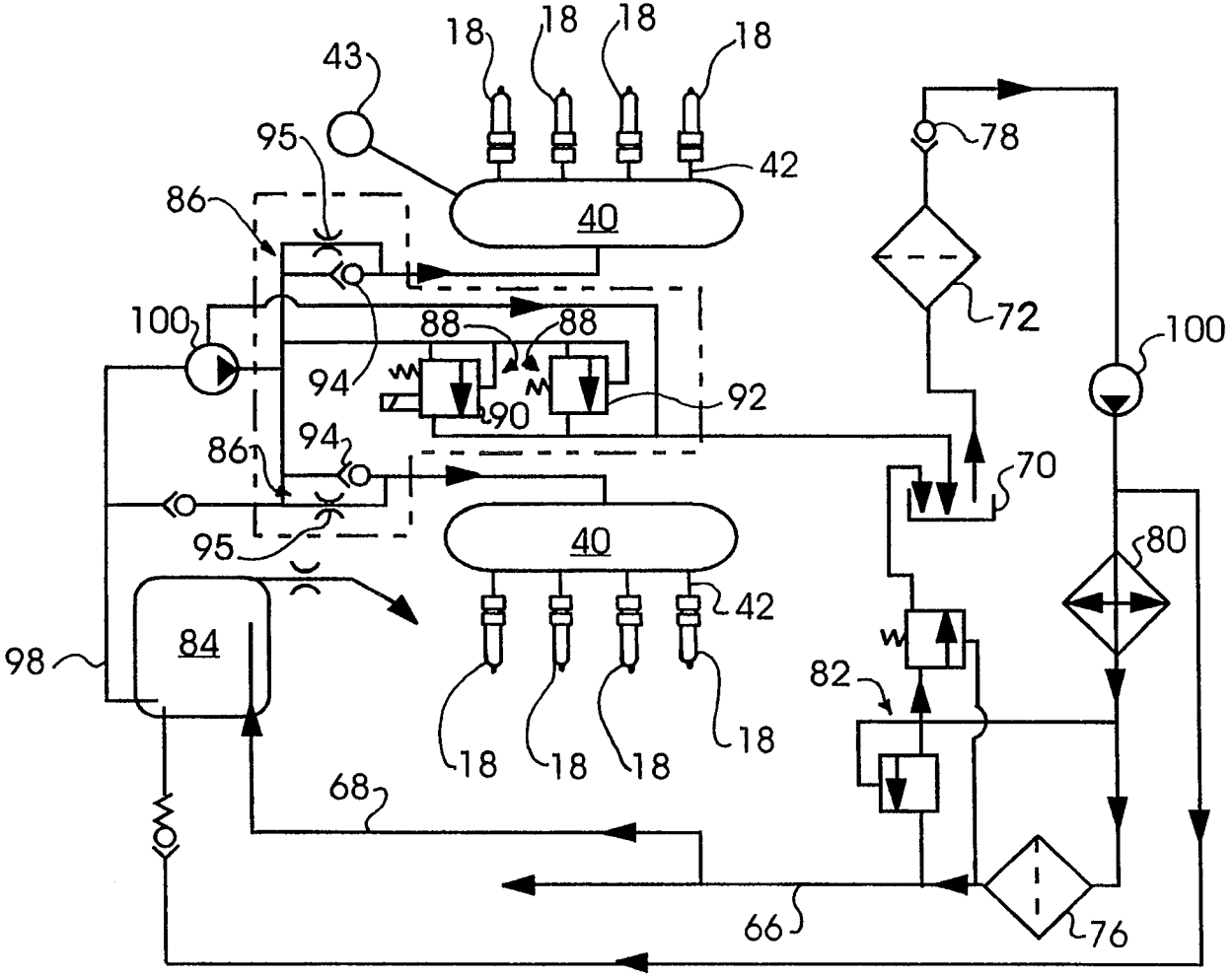
FIG. 3 is a diagrammatic detailed schematic view of the hydraulically actuating fluid and damping fluid supply means generally shown in FIG. 1.

As best shown in FIG. 3, the engines lubrication oil is collected in a sump 70 from which it is pumped through a filter 72 and one-way check valve 78 by a pump 100. The output from pump 100 flows through a cooler 80 and a second filter 76. Oil exiting the filter 76 flows through a line 66 to the engine lubricating system and through a line 68 to a priming reservoir 84. Oil flows from the priming reservoir 84 through a pump supply passage 98 to the high pressure fluid pump 100. The foregoing has been a description of a conventional HEUI fuel injection system. In accordance with this invention, the conventional fluid pump 100 has been replaced by a two-stage gear pump. Two separate embodiments of two-stage gear pumps will be discussed and described in detail.

Figure 4:
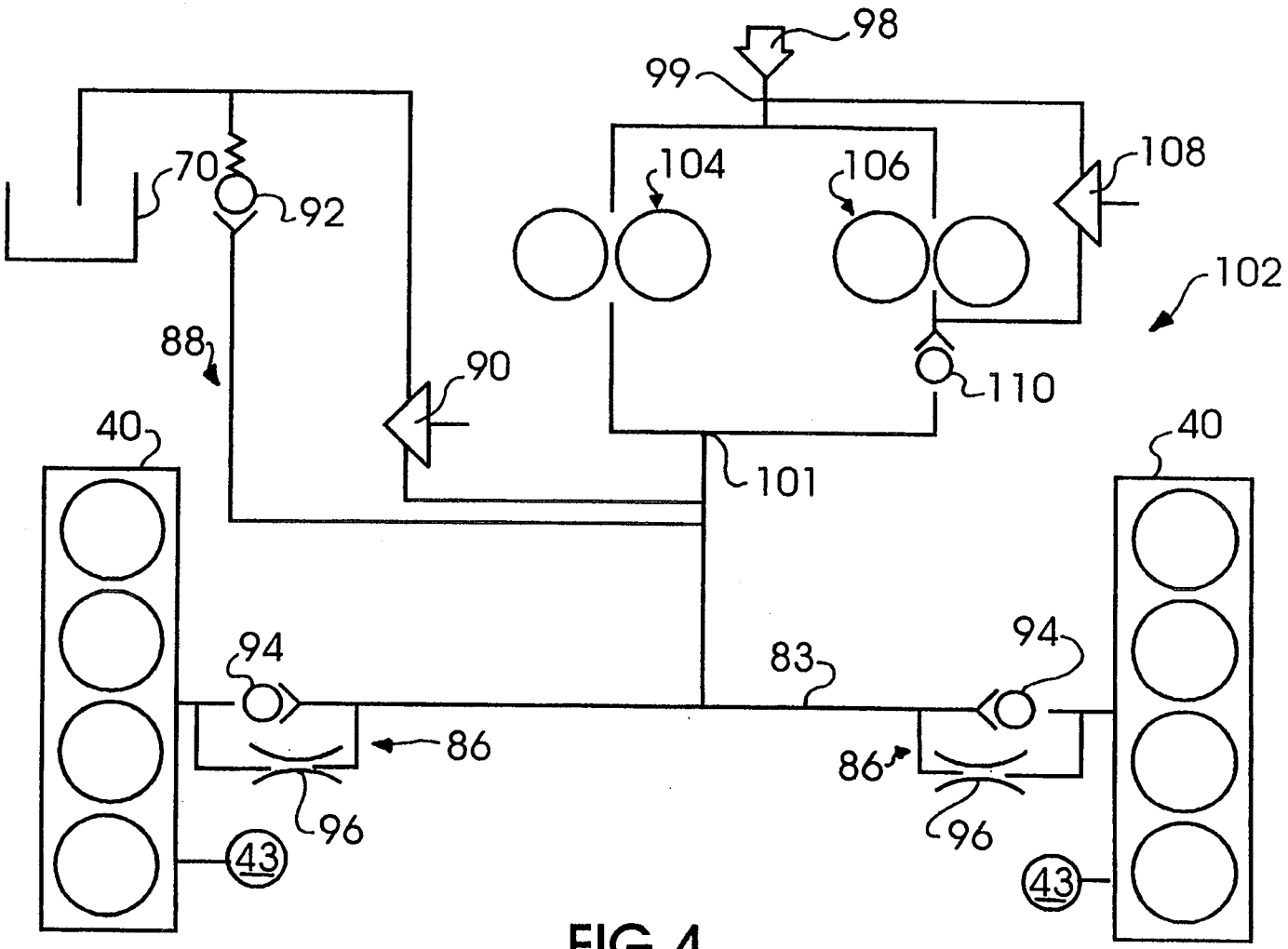
FIG. 4 is a diagrammatic schematic view of the Two-Stage Gear Pump actuating fluid supply embodiment.

Referring now to FIG. 4, the preferred embodiment of a two-stage gear pump 102, having an input port 99 and a discharge port 101 will be discussed and described. Oil is supplied to the input port 99 of the two-stage gear pump 102 through pump supply passage 98 and is split between a first stage gear pump 104 and a second stage gear pump 106.

Figure 6:
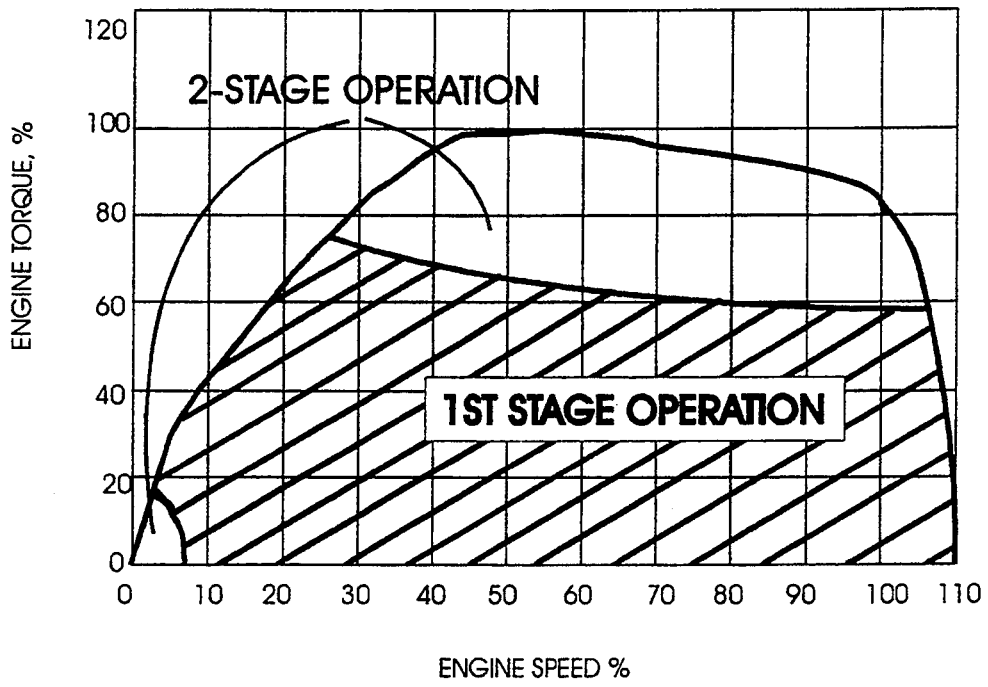
FIG. 6 is a two-stage supply pump operating map shown on a graph of engine torque vs. speed.

FIG. 6 is a graphical illustration of the operation of the two-stage gear pump embodiments. Engine torque as a percentage of peak torque is plotted against engine speed as a percentage of rated speed. The area enclosed under the curve is divided into three separate islands. A small island, labeled 2-STAGE OPERATION, represents starting or cranking the engine. Both first 104 and second 106 stage pumps are utilized in this operation. As the engine speed increases, only the first stage pump 104 is utilized and the second stage pump is placed in a bypass mode. This first stage pump only stage, is represented by the second island of operation which, is labeled 1ST STAGE OPERATION. When engine speed and torque requirements are further increased the output from the second stage pump 106 is again utilized. It is clear from this illustration that at maximum torque both the first 104 and second 106 stage pumps contribute to the total pump system output. This high torque stage is the third island which is labeled 2-STAGE OPERATION. The 1ST STAGE OPERATION is the largest of the three separate islands. Under normal diesel engine use, the engine does not operate continuously in the high torque region. For example, in a pickup truck application, the engine would operate at low speed and part load during the majority of the operating time. Thus, for such a engine for the majority of its operation the actuating oil pump would be operating in the 1ST STAGE OPERATION island. During the 1ST STAGE OPERATION the second stage pump 106 is in the bypass mode and is using almost no power.

Referring again to FIG. 4, pumps 104 and 106 are arranged in parallel. First stage gear pump 104 has a pumping capacity that is sufficient for most operating modes of the engine. For reasons of manufacturing convenience, the second stage pump 106 has the same pumping capacity as the first stage pump 104, and its pumping capacity is utilized when starting the engine and during high load situations. The output of the second stage pump 106 is managed by a first normally-open solenoid controlled bypass valve 108 and a normally-closed outlet check valve 110. During partial load operating conditions, when oil demand is low, fluid is recirculated through a first bypass circuit from the discharge side of pump 106 to the input port 99 of the two-stage gear pump 102. During this recirculation, the energy consumption of second stage pump 106 is reduced to almost zero. When the pressure in the high pressure rails 40 drops below the desired or programmed level, the solenoid-controlled bypass valve 108 closes, the pressure at the discharge side of the pump 106 increases until check valve 110 opens, and fluid exits the two-stage gear pump 102 through the discharge port 101 and flows through high pressure line 83 to the high pressure rails 40.

The output pressure of the two-stage pump 102 is regulated by the rail pressure regulator system 88 that functions to control the pressure level in the high pressure rails 40. The rail pressure regulator system 88 includes an electronically-controlled primary pressure regulator 90 and a one-way relief valve 92. When the pressure in high pressure rails 40 exceeds a desired or programmed level, the electronically-controlled primary pressure regulator 90 is activated which allows fluid to flow through a second bypass circuit extending from the discharge port 101 to the sump 70. The one-way relief valve 92 prevents the pressure in the high pressure rails 40 from exceeding a desired or programmed level.

Fluid from the two-stage gear pump 102 flows through the high pressure line 83 to the Helmholtz valves 86, that function to control the creation of Helmholtz resonance, to the high pressure rails 40. Each Helmholtz valve 86 includes a one-way check valve 94 and a flow restrictor 95.

Figure 7:
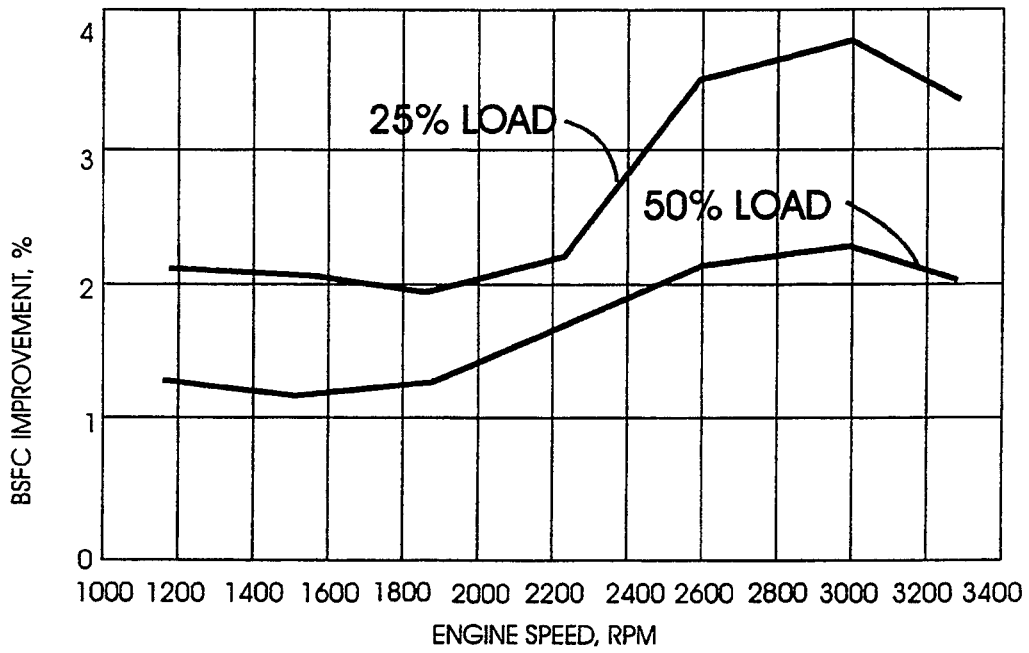
FIG. 7 is a graph showing several fuel consumption reduction curves, for the Two-Stage Gear Pump embodiment, plotted against engine speed.

FIG. 7 displays, in graphical form, computer simulated results that could be expected for the two-stage gear pump embodiment 102 if applied to a diesel engine. This graph shows fuel consumption reduction curves in which the conventional swash plate pump is compared to the two-stage gear pump embodiment 102 running only on the first stage pump due to the load factors used. Both systems use the conventional electronically-controlled primary pressure regulator 90. Two separate curves representing 25% and 50% of engine load are shown. A fuel improvement is indicated for the entire length of both curves. This graphical representation indicates a fuel saving whenever the engine is operating between 25% and 50% of its maximum load. In addition to the improved engine efficiency, the two-stage gear pump embodiment 102 is less costly than the high pressure actuating fluid pump (swash plate type pump) 100 of the prior art.

As discussed above, for manufacturing convenience, both the first stage gear pump 104 and the second stage gear pump 106 have the same capacity. However, the two-stage gear pump embodiment 102 may be further tailored by appropriate sizing of the gear pumps 104, 106 to further improve fuel economy for a specific application by emphasizing the load range predominantly associated with the application at the expense of other load ranges.

For example, in a light load pickup truck application, the engine is operating at low speed and part load during the majority of the operating time. By providing a smaller first stage pump 104, still of sufficient capacity for this low-speed, part-load operation to maintain operation in the 1st stage operation island, less power will be expended to drive the two-stage pump 102 during this time. Although a larger second stage pump 106 will be required to make up the total pumping requirement of the system for peak torque operation, and would consume more power under high load operation, such operation is infrequent in this application and overall fuel economy would improve.

Conversely, better fuel economy will be obtained in an application, such as regional freight hauling, where the majority of operation is at relatively high speed and load, by providing a larger first stage pump and a smaller second stage pump so that the amount of operation in the 2-STAGE OPERATION island of FIG. 6 is reduced. However, low load fuel economy will suffer due to the larger first stage pump.

Figure 5:
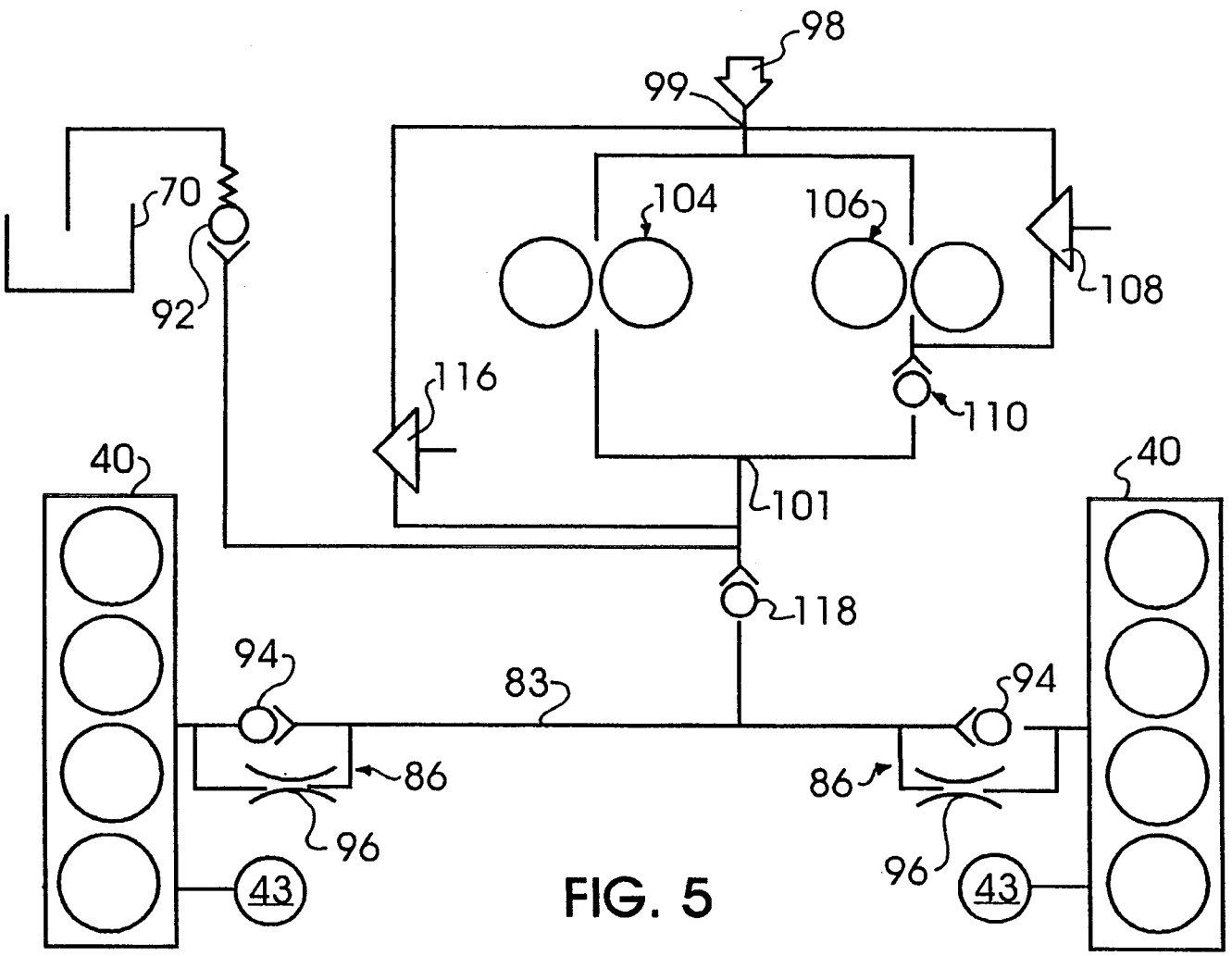
FIG. 5 is a diagrammatic schematic view of the Pulsed Two-Stage Gear Pump actuating fluid supply embodiment.

Referring now to FIG. 5, another embodiment of a two-stage gear pump 120, referred to as a pulsed two-stage gear pump, will be discussed and described. The same reference numbers will be used in describing embodiment 120 as used in describing embodiment 102 for those components that are common to both embodiments. Oil is supplied to the input port 99 of the two-stage gear pump through pump supply passage 98 and is split between a first stage gear pump 104 and a second stage gear pump 106 that are arranged in parallel.

As above, the relative capacities of the first and second stage pump can be variable but for manufacturing convenience are equal in this case. The discharge side of the second stage pump 106 is managed by a normally-open solenoid controlled bypass valve 108 and a normally-closed outlet check valve 110. During partial load operating conditions, when oil demand is low, the output of pump 106 is recirculated through a first bypass circuit from its discharge side to the input port 99 of the pulsed two-stage gear pump 120. During this recirculation, the energy consumption of second stage pump 106 is reduced no almost zero. When the pressure in the high pressure rails 40 drops below the desired or programmed level, the solenoid controlled bypass valve 108 closes, the pressure on the discharge side of the pump 106 increases until first check valve 110 opens, and fluid flows to the discharge port 101 of the two-stage gear pump 120.

First stage gear pump 104 has a pumping capacity that is sufficient for most operating modes of the engine. A second outlet check valve 118 functions to additionally isolate the first stage pump 104 from the high pressure rails 40 thus allowing it to idle when bypassed.

The prior art actuating fluid pumping systems maintained a constant pressure in the high pressure rails 40 at a pressure sufficient to actuate the poppet valves 52 which would cause fuel to be injected into the engine combustion cylinder (an injection event). However, there is no need to maintain this high pressure in the high pressure rails 40 between injection events and the power and fuel expended to maintain this high pressure between injection events is wasted.

Accordingly, in this embodiment the fluid output of the first stage pump 104 and second stage pump 106 is regulated by a fast-response, solenoid-actuated valve 116 that functions to reduce the parasitic losses in the actuating fluid pumping system and significantly reduces the consumption of pumping power. The fast-response, solenoid-actuated valve 116 is designed to bypass the high pressure rails 40 between fuel injection events, through a second bypass circuit in response to a pressure increase in the high pressure rail or rails 40, thus allowing the actuating oil to bypass the high pressure rails 40 and return to the input port 99 of the pulsed two-stage gear pump 120. During this bypass operation, the actuating oil need only overcome the friction resistance present in the fast-response, solenoid-actuated valve 116 and the conduits through which it flows, and thus negligible amounts of power and fuel are expended.

The fast-response, solenoid-actuated valve 116 is a magnetically-latched solenoid which requires a signal to close it and a second signal to open it. Accordingly, the signal $S_9$ transmitted by the engine control module 56 in FIG. 1 is now transmitted by the control module as two appropriately timed signals. First, an underpressure signal is sent to the valve 116 only when the pressure in the high pressure rails drops below a desired or programmed level to close the valve and allow fluid to be pumped to the high pressure rails 40. Secondly, an overpressure signal is sent to the valve 116 only when the pressure in the high pressure rails exceeds a predetermined value (which is higher than the programmed level at which the valve is closed) to open the valve and allow fluid to be bypassed to the two-stage pump input port 99.

With this system, the valve 116 is opened once and closed once for every engine injection event. For a four cycle, eight cylinder engine this valve must cycle four times for each engine revolution. When such an engine is running at 3000 rpm, the valve must cycle 12,000 times per minute or 200 times per second. At this rate, the cycle time for the valve is about 0.005 seconds or 5.0 milliseconds. High speed solenoid valves are currently available, for example, from Anesco Engineering and Manufacturing of Camarillo, Calif., that can satisfy these conditions. Fast-response, solenoid-actuated valves are available, for example, from Anesco Engineering and Manufacturing of Camarillo, Calif., that have a total cycle time of 5.0 milliseconds and open and close in about 0.25 milliseconds or a total switching time of 0.5 milliseconds. Such a valve is thus completely open for about 4.5 milliseconds. The frictional resistance to fluid flow through a valve such as this is a function of the cross-sectional opening of the valve. The resistance becomes smaller as the cross-section of the valve increases. Thus, a large valve opening is preferred to minimize frictional resistance. A valve having a cross-sectional opening of about 3 square millimeters has been found to be acceptable.

Other factors that effect the design of valve 116 are the minimum required high pressure rail pressure, both at maximum engine speed and cranking condition, and pump size. It is important to minimize pump size to optimize efficiency. As pump size increases, the high speed fluid acceleration losses lower the efficiency. Thus, proper pump selection is critical in the design of an efficient system.

The fast-response, solenoid-actuated valve 116 results in the fluid output from the first stage pump 104, and the second stage pump 106 when its bypass 108 is closed, to bypass the high pressure rails 40 between injection events. When the rail pressure exceeds the desired or programmed rail pressure, the solenoid-actuated valve 116 opens, and the gear pump 120 is idled, lowering energy consumption to almost zero. When the fast-response, solenoid-actuated valve 116 is open during bypass operation, the pressure must not exceed the rail pressure to avoid fluid being pumped into the high pressure rails and the pressure should be kept as low as possible to minimize the consumption of pumping energy.

With the fast-response, solenoid-actuated valve 116 open, pressure at the discharge port 101 of the pump system falls and reverse flow from the high pressure rails 40 to the pump system is stopped by the check valve 118. Since the pumping system must deliver actuating fluid at a constant pressure, check valve 118 should be located close to the pump system to minimize the pressure fluctuations in the high pressure line 83 as the fast-response, solenoid-actuated valve 116 opens and closes.

When the fast-response, solenoid-actuated valve 116 is closed, the pressure of the fluid at the discharge port 101 of the pump system increases until the high pressure rail pressure is exceeded and fluid is delivered into the high pressure rails through check valve 118, through high pressure line 83. Fluid from the pulsed two-stage gear pump 120, regardless of whether it flows from the first stage pump 104 or from both pumps 104 and 106, flows through the high pressure line 83 through the Helmholtz valves 86 prior to entering the high pressure rails 40. The Helmholtz valves 86 function to prevent the creation of Helmholtz resonance, and each includes a one-way check valve 94 and a flow restrictor 95.

As previously discussed the pump size is dictated by the maximum engine torque requirements; however, large quantities of actuating oil are also required at the engine starting operation. The quantity of actuating oil required to start, for example, an eight cylinder engine can be reduced by utilizing a four cylinder starting strategy to permit the use of pumps of smaller size and increase the efficiency of the system.

Figure 8:
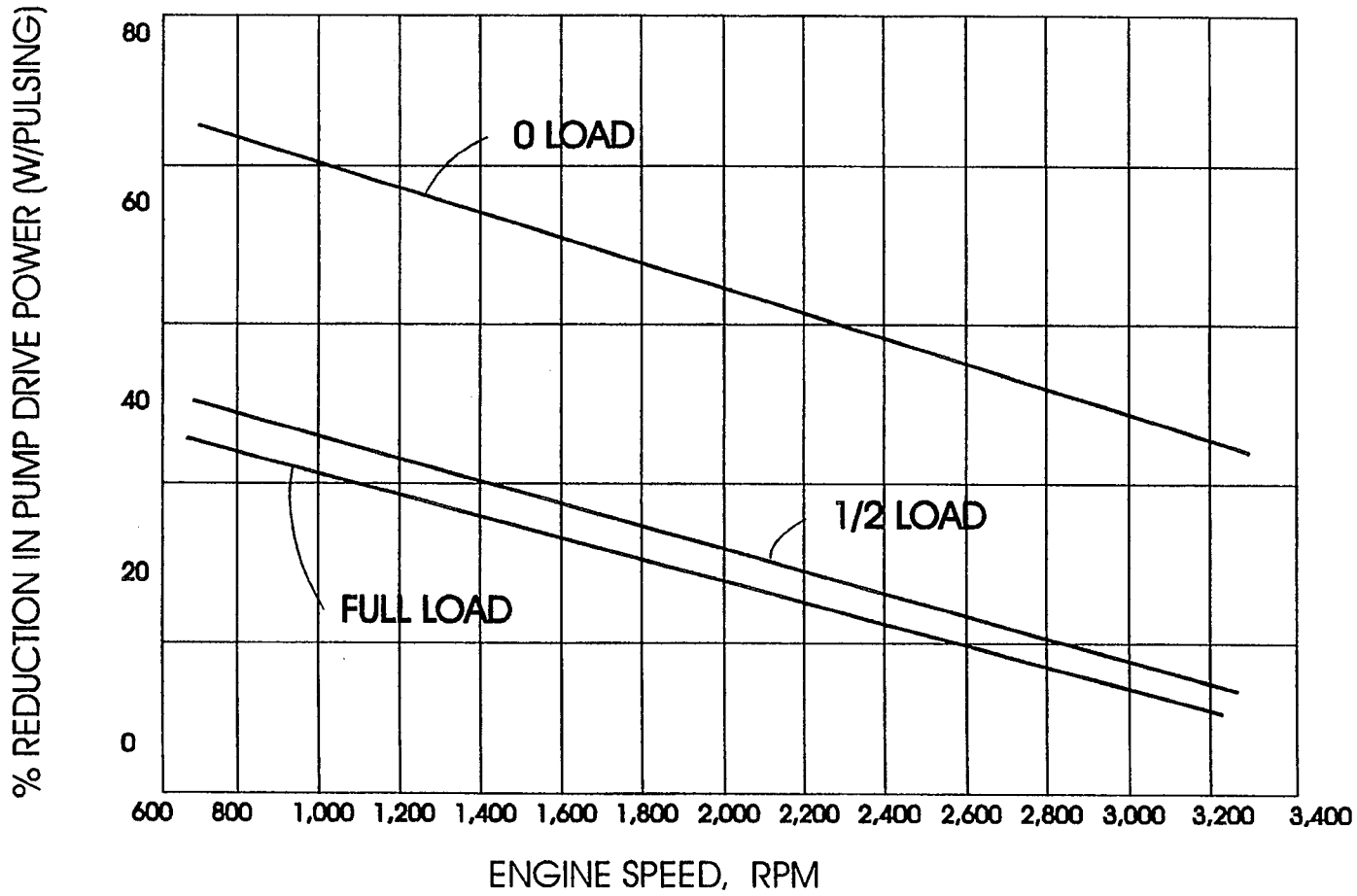
FIG. 8 is a graph showing the estimated reduction in pump drive power under selected amounts of load for the Pulsed Two-Stage Gear Pump embodiment plotted against engine speed.

The graph shown in FIG. 8 shows the estimated reduction in the pump drive power requirements for the pulsed pump as compared to the swash plate pump used in the prior art across the engine speed range under three different engine load conditions. The curves shown in this graph are based upon conservative estimates based on computer modeling which are expected to be confirmed or exceeded upon actual test. The full load curve crosses the zero reduction coordinate at an engine speed of about 2,600 rpm. Thus, at full load there is a reduction of power required to drive the actuation fluid pump system for all engine speeds below 2,600 rpm. At half load there is a reduction of power required to drive the actuation fluid pump system for all engine speeds below about 2,840 rpm. The graph clearly demonstrates that, through the use of the pulsed pump embodiment of the invention, substantial reductions in the power requirements to drive the actuating fluid pump of a HEUI fuel injection system can be achieved throughout most of the operating range of the engine with little penalty in the high load and speed range.

It is intended that the accompanying Drawings and foregoing detailed description is to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

What is claimed is:

1. A fuel injection actuation fluid pump system connected by a high pressure line to at least one high pressure rail associated with an engine for supplying actuating fluid to hydraulically-actuated, electronically-controlled unit injectors associated therewith, said high pressure rail including sensing means for monitoring the fluid pressure in said high pressure rail, and said engine having an electronic microprocessor control programmed to transmit an underpressure signal when the hydraulic pressure in the high pressure rail falls below a desired or programmed level, said pump system including:

an input port connected to a source of actuating fluid and a discharge port connected to said high pressure line;

a first stage gear pump and a second stage gear pump disposed to provide parallel flow being said input port and said discharge port, said second stage gear pump having a discharge side;

a one-way check valve disposed in fluid communication between the discharge side of said second stage gear pump and said discharge port to prevent flow from said first stage gear pump to the discharge side of said second stage gear pump;

a bypass circuit extending from the discharge side of said second stage gear pump to said input port of said pump system; and a normally-open, solenoid-actuated bypass valve in said first bypass circuit, said normally-open, solenoid-actuated bypass valve being operatively associated with said microprocessor and being actuated upon the presence of said underpressure signal therefrom to close, thereby resulting in a fluid pressure increase at said discharge side of the second stage gear pump and permitting fluid to flow through said one-way check valve to said discharge port of the pump system.

2. The invention as set forth in claim 1 and said microprocessor transmitting an overpressure signal when the hydraulic pressure in the high pressure rail raises above a desired or programmed level, and:

a second bypass circuit extending from said high pressure line to the fluid source of the pump system;

a normally-closed, solenoid-actuated bypass valve in said second bypass circuit, said normally-closed, solenoid-actuated bypass valve being operatively associated with said microprocessor and being actuated upon the presence of said overpressure signal therefrom to open to permit fluid from the discharge port of the pump system to flow through said second bypass circuit and return to the fluid source of the pump system.

3. The invention as set forth in claim 1 and:

a second bypass circuit extending from said high pressure line to the fluid source of the pump system;

a check valve disposed in said high pressure line downstream of said second bypass circuit to prevent backflow from said high pressure rail thereinto; and a fast-response, solenoid-actuated bypass valve in said second bypass circuit, said fast response, solenoid-actuated bypass valve being operatively associated with said microprocessor and being actuated upon the presence of said underpressure signal therefrom to close and cause in a pressure increase in said high pressure line, thereby causing fluid to flow through said check valve to said high pressure rail.

4. The invention as set forth in claim 3 and said microprocessor transmitting an overpressure signal when the hydraulic pressure in the high pressure rail raises above a desired or programmed level, and said fast-response, solenoid-actuated bypass valve being actuated upon the presence of said overpressure signal to open and bypass fluid to said input port.

5. The invention as set forth in claim 3 and a plurality of said unit injectors having an injection event during a single revolution of said engine, said fast response, normally-open, solenoid-actuated bypass valve performing a complete open-close cycle between each injection event.

6. The invention as set forth in claim 1 wherein said first stage gear pump has a larger per revolution capacity than said second stage gear pump.

7. The invention as set forth in claim 1 wherein said first stage gear pump has a smaller per revolution capacity than said second stage gear pump.

8. A fuel injection actuation fluid pump system connected by a high pressure line to at least one high pressure rail associated with an engine having a sump for supplying lubricating oil for actuating hydraulically-actuated, electronically-controlled unit injectors associated therewith, said high pressure rail including a sensor for monitoring the lubricating oil pressure in said high pressure rail, and said engine having an electronic microprocessor control programmed to transmit an underpressure signal when the hydraulic pressure in the high pressure rail falls below a desired or programmed level, said pump system including:

an input port operatively associated with said sump and a discharge port connected to said high pressure line;

a first stage gear pump and a second stage gear pump arranged in parallel to receive flow from said input port, said first stage gear pump having a discharge side and said second stage gear pump having a discharge side, said discharge sides being joined at said high pressure line;

a normally-closed, one-way check valve disposed to prevent fluid communication from said high pressure line to said second stage gear pump discharge side;

a first bypass circuit extending from the discharge side of said second stage gear pump to said input port of said pump system; and a first normally-open, solenoid-actuated bypass valve in said first bypass circuit, said first normally-open, solenoid-actuated bypass valve adapted to receive and be actuated by said underpressure signal from said microprocessor, said first signal causing said first normally-open, solenoid-actuated bypass valve to close resulting in a pressure increase at said discharge side of the second stage gear pump and opening said normally-closed, one-way check valve permitting lubricating oil to flow to said discharge port of the pump system.

9. The invention as set forth in claim 8 and said microprocessor further transmitting an overpressure signal when the hydraulic pressure in the high pressure rail raises above a desired or programmed level, and:

a second bypass circuit extending from said high pressure line to the sump;

a normally-closed, solenoid-actuated bypass valve in said second bypass circuit, said normally-closed, solenoid-actuated bypass valve being operatively associated with said microprocessor and being actuated upon the presence of said overpressure signal therefrom to open to permit lubricating oil from the discharge port of the pump system to flow through said second bypass circuit and return to the sump.

10. The invention as set forth in claim 8 further comprising:

a second bypass circuit extending from said high pressure line to said input port of the pump system;

a fast-response, solenoid-actuated bypass valve in said second bypass circuit, said fast-response, solenoid-actuated bypass valve being normally-open to allow lubricating oil to flow through said second bypass circuit and being actuated upon the presence of said underpressure signal from said microprocessor to close the bypass of the first stage pump and permit lubricating oil in said high pressure line to flow to the high pressure rail; and a normally-closed, one-way check valve in said high pressure line downstream of said second bypass circuit that functions to permit bypassing of said two-stage gear pump.

11. The invention as set forth in claim 10 in which said fast-response, solenoid-actuated bypass valve is disposed to be actuated by an overpressure signal from said microprocessor, this actuation of said normally-open, fast-response, solenoid-actuated bypass valve opening said second bypass circuit and causing the output of said first stage pump to be bypassed to the input port of the pump system.

12. The invention as set forth in claim 10 in which said normally-open, fast-response, solenoid-actuated bypass valve has the capacity to complete a open-close cycle in less than about 5 milliseconds.

13. The invention as set forth in claim 10 and a plurality of said unit injectors having an injection event during a single revolution of said engine, said fast response, normally-open, solenoid-actuated bypass valve performing a complete open-close cycle between each injection event.

14. The invention as set forth in claim 10 in which said normally-open, fast-response, solenoid-actuated bypass valve has a cross sectional area of about 3 square millimeters.

15. The invention as set forth in claim 8 wherein said first stage gear pump has a larger per revolution capacity than said second stage gear pump.

16. The invention as set forth in claim 8 wherein said first stage gear pump has a smaller per revolution capacity than said second stage gear pump.

17. In a diesel engine having a plurality of hydraulically-actuated, electronically-controlled unit fuel injectors, and an actuating fluid reservoir, a hydraulic actuation fluid pump system and connected by a high pressure line to at least one high pressure rail of said engine for supplying actuating fluid to said injectors, said high pressure rail including a sensor for monitoring the fluid pressure therein, and said engine including an electronic control module responsive to said sensor and programmed to transmit an underpressure signal when the hydraulic pressure in the high pressure rail falls below a desired or programmed level and an overpressure signal when the hydraulic pressure in the high pressure rail exceeds a desired or programmed level, said pump system including:

an input port drawing an actuating fluid supply from said reservoir and a discharge port connected to said high pressure line;

a gear pump;

a bypass circuit extending from said high pressure line to said input port of the pump system;

a normally-open, fast-response, solenoid-actuated bypass valve disposed in said bypass circuit, said normally-open, fast-response, solenoid-actuated bypass valve being operatively associated with said control module to be actuated by said underpressure signal therefrom to close the bypass circuit of the pump system and permit fluid to flow through said high pressure line to the high pressure rail; and a normally-closed one way check valve in said high pressure line downstream of said bypass circuit that functions to prevent flow from said rail to said bypass circuit.

18. The invention as set forth in claim 17 in which said normally-open, fast-response, solenoid-actuated bypass valve is operatively associated with said control module to be actuated by said underpressure signal therefrom to open said bypass circuit and cause the output of said pump to be bypassed to the input port of the pump system.

19. The invention as set forth in claim 17 and a plurality of said unit injectors having an injection event during a single revolution of said engine, said fast response, normally-open, solenoid-actuated bypass valve performing a complete open-close cycle between each injection event.

20. The invention as set forth in claim 19 in which said normally-open, fast-response, solenoid-actuated bypass valve has the capacity to complete a close-open in less than about 5 milliseconds.

21. The invention as set forth in claim 19 in which said gear pump comprises a second parallel pump connecting said input port and said discharge port, said second pump having a second stage bypass circuit connecting a discharge side of said second pump and said input port, a normally-open solenoid valve disposed in said second stage bypass circuit, said normally-open solenoid valve being operatively associated with said control module and being actuated upon the presence of said underpressure signal therefrom to close, and a one-way check valve disposed between the discharge side of said second pump and said discharge port to prevent the reverse flow of fluid thereinto while permitting fluid to flow through said one-way check valve to said discharge port of the pump system.

* * * * *